United States Patent [19]

Knudsen

[11] Patent Number: 4,461,030

[45] Date of Patent: Jul. 17, 1984

[54] BAG AND CLOSURE THEREFOR

[76] Inventor: Phillip E. Knudsen, Suite 827, 2301 Jeff. Davis Hwy., Arlington, Va. 22202

[21] Appl. No.: 429,832

[22] Filed: Sep. 30, 1982

[51] Int. Cl.[3] ..... A41D 13/00

[52] U.S. Cl. ..... 224/222; 2/22; 36/2 R; 383/43; 383/87

[58] Field of Search ..... 224/222, 219; 206/260; 229/53, 62; 150/3, 7, 12, 11, 1; 2/252, 254, 16, 22, 24; 383/43, 87, 86; 36/2 R

[56] References Cited

U.S. PATENT DOCUMENTS

| | | | |
|---|---|---|---|
| 1,310,869 | 7/1919 | McHugh | 150/3 |
| 1,328,884 | 1/1920 | Miller, Jr. | 2/252 |
| 1,643,023 | 9/1927 | Marino | 36/2 R |
| 1,791,357 | 2/1931 | Guarino | 36/2 R |
| 2,236,024 | 3/1941 | Tyler | 206/260 |
| 2,291,414 | 7/1942 | Slobotkin | 2/254 |
| 2,428,227 | 9/1947 | Kase | 150/3 |
| 3,074,405 | 1/1963 | Duensing | 2/22 X |
| 3,462,764 | 8/1969 | Caster | 2/252 |
| 3,477,068 | 11/1969 | Rizzo | 2/252 |
| 3,670,933 | 6/1972 | Jones | 224/222 |
| 3,696,917 | 10/1972 | Levi | 206/260 |
| 4,001,953 | 1/1977 | Fugere et al. | 36/2 R |
| 4,306,315 | 12/1981 | Castiglia | 2/22 |
| 4,344,189 | 8/1982 | Futere et al. | 2/16 |

FOREIGN PATENT DOCUMENTS 224507 1/1959 Australia .

*Primary Examiner*—Steven M. Pollard
*Assistant Examiner*—Bryon P. Gehman

[57] ABSTRACT

A bag formed from a single sheet of flexible material having two ends and two edges folded parallel to the ends to provide front and back surfaces that are sealed together along the edges to provide a pocket. Each of the surfaces extends toward an opening into the pocket through which articles for support may pass and from which articles may be removed. One of the surfaces extends beyond the opening of the pocket and is folded over the end of the other surface. The end of the folded over surface is positioned directly below the end of the other surface outside of the bag and elastic members are held captive within the ends whereby by stretching the bag in the direction of the sealed edges and maintaining the bag in a stretched condition a plurality of closure seals are formed to close the opening to the bag. In addition, when the bag is joined sealed edge to sealed edge and stretched around a form, the stretched ends of the bag that form the opening to the bag also support the bag around the form.

11 Claims, 3 Drawing Figures

BAG AND CLOSURE THEREFOR

TECHNICAL FIELD

This invention relates to improvements in flexible bags that are provided with closures through which articles for support may pass and from which articles may be removed.

BACKGROUND OF THE INVENTION

Bags provided with closures through which articles for support may pass and from which articles may be removed have been widely accepted. A typical example of such a bag is shown in U.S. Pat. No. 2,428,227 to Kase. The ends of the surfaces do overlap to form a closure but only one seal is formed. Furthermore it is overly complex and difficult to manufacture due to the number of unrelated parts. Another example of such a bag is shown in U.S. Pat. No. 2,291,414 to Slobotkin.

It is therefore the object of this invention to overcome the shortcomings of these and other prior art devices and to provide a bag of this type having multiple seals to maintain the opening to a bag in a closed condition when the bag is stretched lengthwise and maintained stretched.

It is a further object of this invention to provide a bag that utilize the same elements that securely close the opening to the bag to secure the bag around a form such as a human leg or the like.

SUMMARY OF THE INVENTION

In accordance with the present invention, a bag is comprised of a single sheet of flexible material having two ends and two edges or sides (herein referred to as edges) folded parallel to the ends to provide front and back surfaces that are sealed together along the edges to provide a pocket. Each of the two surfaces extends toward an opening into the pocket through which articles for support may pass and from which articles may be removed. One of these surfaces extends beyond the opening to the bag and is folded over the end of the other surface to form a flap which is sealed along its edges to the edges of the bag. The only opening into the bag is between the folded over end and the end of the adjacent surface. An elastic strip under tension and rubber like foam material are encased in the two ends and connected to the sealed edges of the bag.

When the bag is stretched lengthwise in the direction of these edges and maintained stretched as by mounting it around a form, the elastic strips and rubber like foam material in the ends forming the opening act toward the surfaces of the bag to close the opening thereto, while at the same time acting toward each other.

While some of the objects and advantages of the invention have been discussed above, other objects will appear when taken in conjunction with the accompanying drawings.

BRIEF DESCRIPTION OF THE PREFERRED EMBODIMENT

FIG. 1 is a perspective view of the bag prior to being stretched lengthwise. The ends forming the opening into the bag are separated to show detail. The arrows show the direction in which the bag is stretched lengthwise and folded to join the sealed edges together.

BEST MODE FOR CARRYING OUT THE INVENTION

Figure 1:
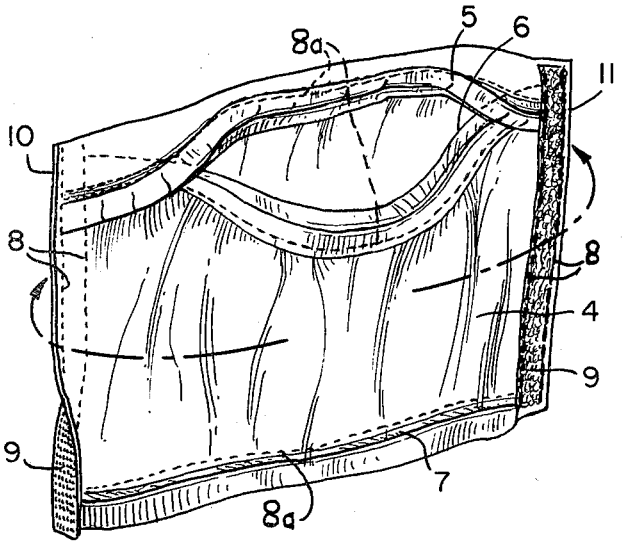
Figure 2:
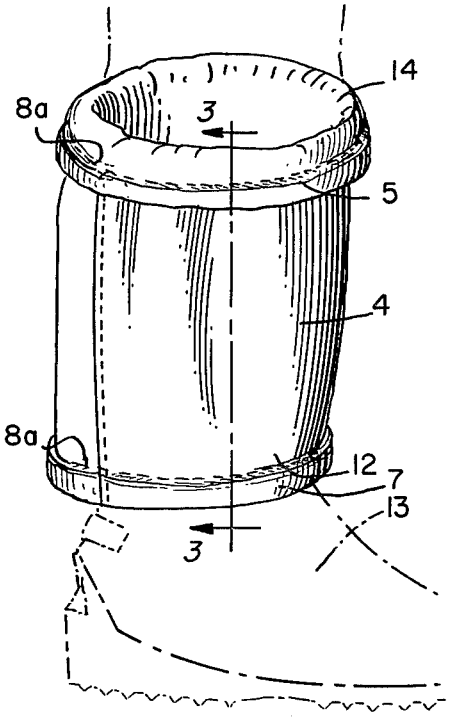
FIG. 2 is a perspective view of the bag of the invention stretched lengthwise and mounted about a form. The ends forming the opening into the bag are in the closed position.

Referring to FIG. 1, a bag 4 is shown comprising a single sheet of fabric. The edges 10 and 11 of the bag 4 are sealed together by one or more rows of stitching 8. The ends 5 and 6 of the continuous sheet of fabric define the opening into the bag 4. Stitching 8*a* forms a border along the ends 5, 6 and fold 7 which are sealed to the edges 10 and 11 by stitching 8. Also disposed along the sealed edges 10 and 11 are strips of hook and loop fasteners 9 attached by stitching 8. An elastic strip under tension and rubber like foam material are held captive in each of the borders along ends 5 and 6 which define the opening into the bag and along fold 7 which forms the bottom of the bag. When the bag 4 is stretched lengthwise in the direction of the arrows, it may be wrapped around a form and fastened together sealed edge to sealed edge by mating the surfaces of the hook and loop fasteners 9 as shown in FIG. 2 wherein the bag 4 acquires a tubular shape conforming to the calf portion of a human leg (dotted lines) in the upper region 14 of the bag 4 and conforming to the top of a boot 13 at the lower region 12 of the bag 4. Only the borders formed by stitching 8*a* along end 5 and fold 7 are visible. The other end 6 of the bag 4 which forms a part of the opening to the bag is hidden from view, surrounded by and disposed above end 5.

Figure 3:
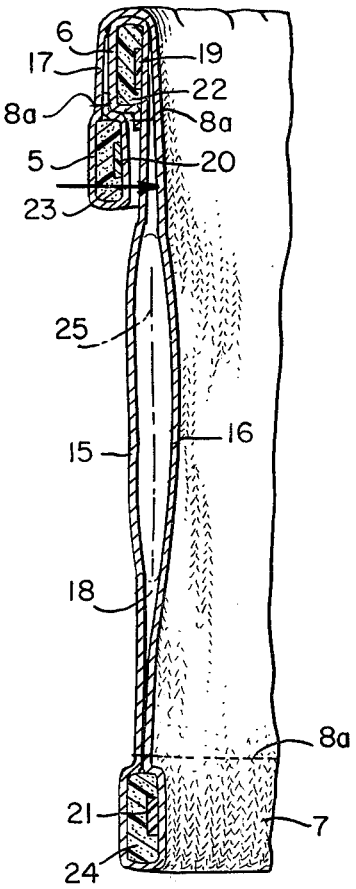
FIG. 3 is a cross-sectional perspective view along line 3—3 of FIG. 2 but with flap end and adjacent surface end extended outward slightly opposite the direction of the arrow for the purpose of showing increased detail.

In FIG. 3, the bag 4 is shown in considerable detail. The end 5 of flap 17 and the end 6 on surface 15 have been extended outward to make it easier to identify the component parts. Were the aforementioned parts not separated for the purpose of clarity, they would all be drawn together when the bag 4 is stretched lengthwise and mounted around a form in the direction of the arrow with no spacing between surface 15 and 16 above the lowermost portion of end 5.

Now specifically referring to FIG. 3, the bag comprises a single sheet of flexible material having a fold 7 to provide a front surface 15 and a back surface 16 which are sealed together along the edges of the bag to provide a pocket 18. Each of the surfaces 15 and 16 extends toward the opening of the pocket through which an article 25 for support may pass and from which article 25 may be removed. Surface 16 extends beyond the opening and is folded over end 6 of surface 15 to form flap 17 with end 5. End 5 is positioned below end 6 and fastened to the sealed edges of the bag. An elastic strip 19 under tension and a foam rubber like material 22 are held captive within end 6 generally by stitching 8*a*. Similarly an elastic strip 20 under tension and a foam rubber like material 23 are held captive within end 5. And finally an elastic strip 21 under tension and a foam rubber like material are held captive within fold 17 generally by stitching 8*a* between surface 15 and surface 16. The two ends 5 and 6 and fold 7 have a thick cross-section relative to the surfaces 15 and 16 and the flap 17. The elastic strips 19, 20 and 21 are all positioned inwardly of the foam rubber like material 22, 23 and 24, respectively, relative to the opening of the pocket 18 to facilitate frictional engagement against surfaces 15 and 16 when the bag 4 is stretched lengthwise in the direction of the sealed edges 10 and 11.

End 5 and end 6 are positioned one on top of the other in a nested relationship when they are fastened to the sealed edges of the bag, thereby permanently joining their outer edges but permitting free movement between the sealed edges, one relative to the other, to permit access to the pocket 18.

Although it is not shown, it is important to note that the elastic strip 20 in end 5 is under greater tension than the tension of the elastic strip 19 in end 6. The greater tension in elastic strip 20 in end 5 enables end 5 to act upon surfaces 15 and 16 with greater force than end 6 upon surface 16 when the bag is stretched lengthwise and maintained stretched. The lesser tension in end 6 enables it to be pulled downwardly when an article 25 is placed in the pocket 18 which in turn extends an outward force on surface 15, thereby forming a pressure seal between the lower portion of end 6 and the upper portion of the overlapping end 5 which acts with considerable force against surface 15 and surface 16 in the direction of the arrow, thereby preventing the end 6 from any further downward movement beyond the seal against the upper portion of end 5.

The rubber like (compressible and stretchable) foam 22, 23 and 24 runs substantially the entire length of the ends 5 and 6 and the fold 7. The rubber like foam, in addition to providing the overlapping and nesting thickened ends also acts to prevent the fabric forming the casings around the elastic strip from bunching up along the length of the ends 5 and 6 and the fold 7. Preferably the foam rubber like material 22 and 23 has a substantially rectangular cross-section as shown in FIG. 3 to increase the frictional engagement between the upper portion of end 5 and the lower portion of end 6 when the bag 4 is stretched lengthwise in the direction of the sealed edges and maintained stretched. Foam rubber like material 24 has a substantially rectangular shape in cross-section for cosmetic symmetry among the three foam rubber portions 22, 23 and 24. Furthermore, if desired, the foam rubber like material 22, 23 and 24 may be utilized alone and the elastic strips 19, 20 and 21 may be omitted. The preferred embodiment, however, utilizes the combination of foam rubber like material 22, 23 and 24 and elastic strips 19, 20 and 21.

Once the carryall bag is in place about its support, as shown in FIG. 2, entry to the pocket is gained by further tensioning the outermost end 5 near its mid-section in the direction opposite the direction of the arrow in FIG. 3 and upward thereby permitting access to end 6, which is further tensioned near its mid-section in the direction opposite the direction of the arrow in FIG. 3 and slightly downward to allow the end 5 to pass over end 6 near their respective mid-sections as shown in FIG. 1. Due to the greater action exerted by end 5 compared to end 6, end 6 is prevented from returning to its closed position and thus an open pocket is formed. To close the opening, the outermost end 5 is again further tensioned near the mid-section in the direction opposite the direction of the arrow in FIG. 3 and downward so that it again overlaps end 6 along their entire lengths respectively. By utilizing the resealable closure means for a flexible bag as shown in the preferred embodiment of the invention, as shown in the drawings, any object placed in the bag must pass through four distinct closed regions to exit the bag. The first region is where end 5 acts against surface 15 and surface 16 in FIG. 3. The second region is where end 6 acts against surface 16. The third region is where the lowermost surface of end 6 contacts the uppermost surface of end 5, and the fourth region is where end 5 acts against surface 15. Thus, by utilizing two overlapping ends 5 and 6, as shown in FIG. 3, four distinct seals or closures are provided. In the preferred embodiment, as shown in the drawings, a flexible bag of this invention is joined together along its sealed edges to form a continuous tube which is stretched around a form. However, it is not a necessity that the sealed edges of the bag be connected end to end to actualize the benefits of the resealable closure means of this invention. It is only necessary that the bag be utilized in such a fashion that the opposite sealed edges are extended lengthwise and then attached to a flat surface or by mounting the sealed edges of the bag between two stationary objects after the sealed edges have been stretched lengthwise. While either the flat elastic strips 19, 20 and 21 or the foam rubber like material 22, 23 and 24 may be omitted, the combination of the elastic strips 19, 20 and 21 and the foam rubber material 22, 23 and 24 provides the best results. It should further be mentioned that while specific materials have been suggested in the preferred embodiment, other similar materials could be substituted without departing from the scope of the invention.

Although a preferred embodiment of the invention has been disclosed in detail for illustrative purposes, it will be recognized that variations or modifications of the disclosed apparatus, including the re-arrangement of parts, lie within the scope of the present invention.

We claim:

1. A bag comprising at least one sheet of a flexible material, having two ends and two ends, folded parallel to the ends to provide a front and back surface and sealed substantially along the edges to provide a pocket, each of said surfaces extending toward an opening into said pocket through which articles for support may pass and from which articles may be removed, one of said surfaces extending beyond said opening and folded over the end of said other surface so that the end of the folded over surface is positioned below the end of the other surface throughout substantially their entire lengths, and the folded over end is positioned outside of said bag, and elastic means under tension at each of the ends for drawing said sealed edges toward each other and when said bag is stretched in the direction of said sealed edges and maintained in a substantially stretched condition the elastic means of one end acts toward the plastic means of the other end throughout substantially the entire length of the ends and said elastic means of one end acts toward one surface of the bag and said elastic means of the other end acts toward both surfaces of the bag below the first mentioned end throughout substantially the entire length of the ends to provide a plurality of closure seals at said opening.

2. The bag and closure means recited in claim 1 wherein said elastic means at each end comprises a strip of stretchable flat material.

3. The bag and closure means recited in claim 1 having thickened ends for providing increased frictional engagement between said ends when the surface adjacent said folded over end is expanded outward and downward by placing an article into said pocket.

4. The bag and closure means recited in claim 3 wherein said thickened ends comprise a foam rubber type material at substantially rectangular cross-section held captive within said ends and substantially co-extensive in length to the space between the sealed edges.

5. The bag and closure means recited in claim 3 wherein said elastic means is positioned along the innermost region of each of said thickened ends in the direction of the opening into said pocket.

6. The bag and closure means recited in claim 3 wherein said ends overlap one another and nest one on top of the other.

7. The bag and closure means recited in either one of claims 1 or 3 wherein said elastic means of the end folded over said other end is under tension greater than the tension of elastic means at said other end to allow the last-mentioned end to move downward and increase the frictional engagement between said ends along their entire lengths so long as the adjacent surface is expanded outward and downward by inserting an article into said pocket.

8. The bag and closure means recited in claim 1 wherein releasable connecting means are disposed along said sealed edges of said front and back surfaces for joining the sealed edges together to form a tubular body which is stretched over a form such as a human leg, said elastic means at said ends thereby acting to close the opening to said pocket and to secure said bag to said form.

9. A bag comprising at least one sheet of flexible material, having two ends and two edges, folded parallel to the ends to provide a front and back surface and sealed substantially along the edges to provide a pocket, each of said surfaces extending toward an opening into said pocket through which articles for support may pass and from which articles may be removed, one of said surfaces extending beyond said opening and folded over the end of said other surface so that the end of the folded over surface is positioned below the end of the other surface throughout substantially their entire lengths, and the folded over end is positioned outside of said bag, and a compressible and stretchable material held captive within said ends and substantially co-extensive in length to the space beween the sealed edges and overlapping one another and nesting one on top of the other and when said bag is extended in the direction of said sealed edges, and maintained in a substantially stretched condition, the overlapping ends nest firmly together in a frictional engagement throughout substantially the entire length of the ends and one of said ends acts toward one surface of the bag throughout substantially the entire length of the ends and said other end acts toward both surfaces of the bag below the first mentioned end throughout substantially the entire length of the ends to provide four closure seals at said opening.

10. The bag and closure means recited in claim 9 wherein said ends are substantially rectangular in cross-section.

11. The bag and closure means recited in claim 9 wherein said compressible and stretchable material in said ends is sealed to the bag at said sealed edges.

* * * * *

UNITED STATES PATENT AND TRADEMARK OFFICE

CERTIFICATE OF CORRECTION

PATENT NO. : 4,461,030

DATED : July 17, 1984

INVENTOR(S) : Phillip E. Knudsen

It is certified that error appears in the above-identified patent and that said Letters Patent is hereby corrected as shown below:

Column 1, line 28, "utilize" should read -- utilizes --.

Column 4, line 34, "ends", second occurrence, should read -- edges --.

Column 4, line 51, "plastic" should read -- elastic --.

Column 4, line 68, "at" should read -- of --.

Signed and Sealed this

*Fourth* Day of *June 1985*

[SEAL]

*Attest:*

DONALD J. QUIGG

*Attesting Officer* *Acting Commissioner of Patents and Trademarks*